US006059651A

United States Patent [19]

Abe et al.

[11] Patent Number: 6,059,651

[45] Date of Patent: May 9, 2000

[54] APPARATUS FOR LIFTING CIRCULAR PLATE BODIES

[75] Inventors: Hiroshi Abe; Tetsuo Furukawa, both of Iwatsuki, Japan

[73] Assignee: Asahi Seiko Co., Ltd., Japan

[21] Appl. No.: 09/116,162

[22] Filed: Jul. 15, 1998

[51] Int. Cl.[7] ..... G07D 1/00

[52] U.S. Cl. ..... 453/50; 221/267

[58] Field of Search ..... 453/32, 50; 221/267; 194/344

[56] References Cited

U.S. PATENT DOCUMENTS 4,518,001 5/1985 Branham ..... 221/267 X 5,810,655 9/1998 Suzukawa et al. ..... 453/50

*Primary Examiner*—F. J. Bartuska

*Attorney, Agent, or Firm*—Philip J. Anderson; Quirk & Tratos

[57] ABSTRACT

A device is set forth for dispensing circular plate bodies such as coins which has a channel to push the coins in an end-to-end relationship from to an outlet. A roller is biased to engage the coin emerging from the channel and to be pushed by the emerging coin as it exits. A gear on the shaft mounting the roller and a fixed rack rotates the roller to eject to coin.

6 Claims, 7 Drawing Sheets

APPARATUS FOR LIFTING CIRCULAR PLATE BODIES

FIELD OF THE INVENTION

The present invention relates to apparatus such as elevator and coin handling apparatus for dispensing coins from a hopper.

BACKGROUND OF THE INVENTION

Coin handling apparatus are known of the type described in U.S. Pat. No. 4,518,001. The device disclosed in this patent contains a coin pay out assembly having a hopper and an elongated duct which has front and back panels and first and second edged panels defining a channel to accept coins which are arranged in a single, edge-to-edge arrangement between a lower channel inlet and an upper channel outlet. The outlet end of the channel communicates with the pay out chute. A coin ejector assembly includes a ejector member for forcible ejecting coins at the outlet end of the channel through an outlet slot. This ejector, according to the aforementioned patent, includes a roller rotatably disposed on an axis substantially normal to the front and back panels and moveable between a first position close to an edge panel and an off center position relative to the width of the channel. The ejector member is biased such that when the coin in the top most position in the chute engages the roller, the roller is displaced relative to the bias until the coin aligns with the outlet slot whereupon the bias urges the coin from the outlet slot for dispensing.

In conventional handling apparatus of the type described above, the ejector member must be provided with a roller which is moveable between the first position and second position in a direction away from the outlet slot. In other words, according to these prior devices, the position of the roller for the ejector member must always be further in distance than the radius of the coin relative to the position of the coin ejecting outlet.

The present invention is directed to an ejector apparatus where the position of the roller for an ejector member is not related to the radius of the coin to be ejected. In other words, the position of the roller for the ejector according to the present invention is not changed, even if the size of the coin to be dispensed is changed. The present invention has been developed for the purpose that 50 Yen coins with a small diameter and also 10 Yen coins with a large diameter can be used without changing the position for a roller for equipment which uses different diameter 100 Yen coins.

SUMMARY OF THE INVENTION

There is, therefore, set forth according to the device of the present invention, a device for dispensing circular plate bodies such as coins which includes a frame defining a channel to guide the bodies fed into the channel at a inlet end in an edge-to-edge arrangement to be ejected from a channel outlet end. A roller disposed at the outlet end of the channel to engage the body of the edge-to-edge arrangement at the outlet end. Means are provided for rotating the roller in a first direction to urge the body to one side from the channel for ejection thereof. Also included are means for biasing the roller to contact the body during ejection and to return to engage the next body to be ejected presented from the channel at the outlet end. The rotating means may include a gear coupled to the roller for rotation therewith and a rack adapted to mesh with the gear to rotate the roller in first and second directions in response to displacement of the roller and means for preventing the roller from rotating in one direction. These preventing means may be a one way clutch.

BRIEF DESCRIPTION OF THE DRAWINGS

These and other features and advantages will become better appreciated as the same becomes better understood with reference to the specification, claims and drawings wherein:

DESCRIPTION

Figure 1:
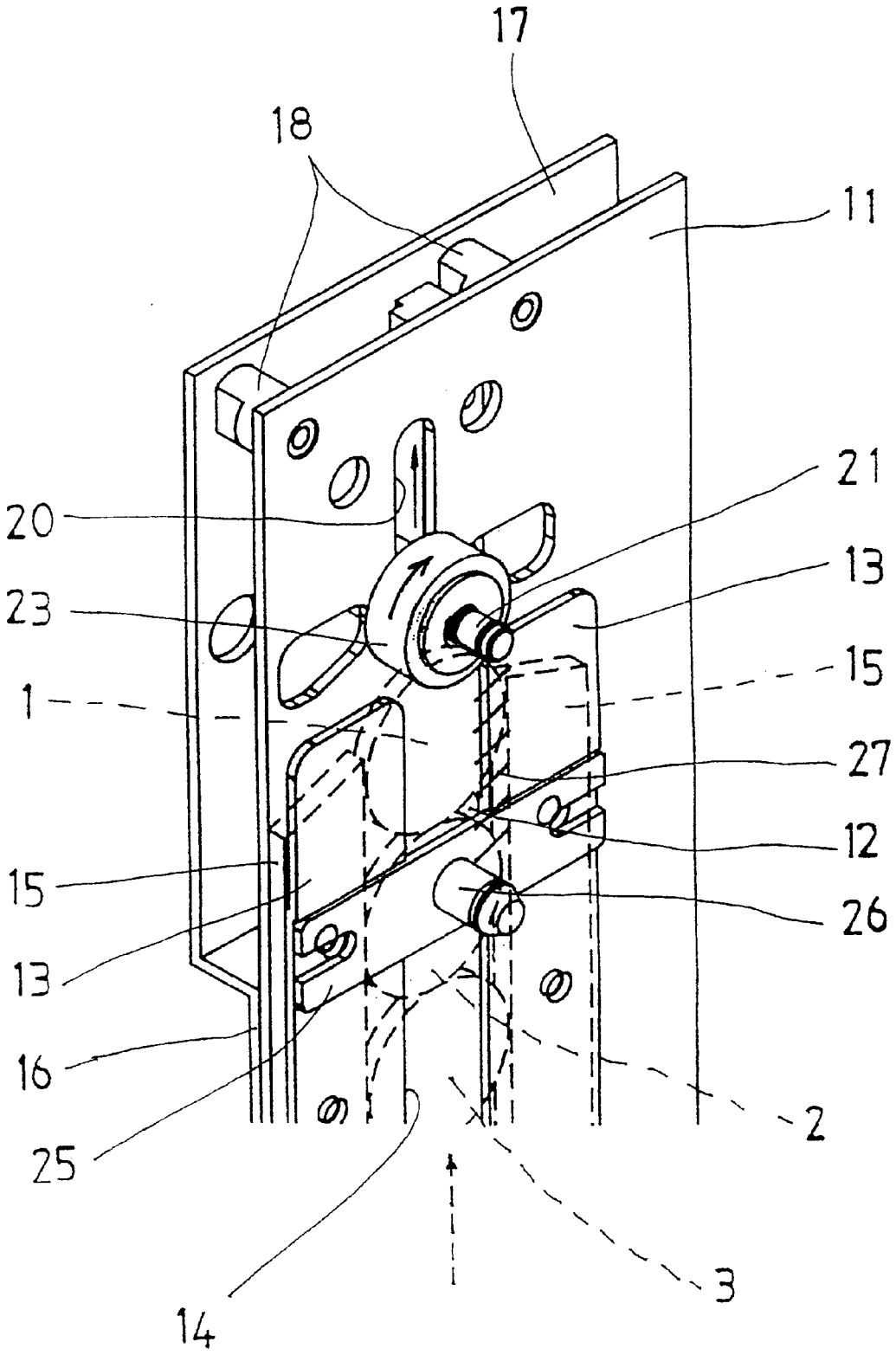
FIG. 1 is a perspective view of the outlet end of the channel according to the present invention.

Turning to the drawings, FIG. 1 shows a device according to the present invention which includes a back plate 11 which cooperates with the other components to define a channel 12 for a circular plate body which may be coins 1–3 aligned edge-to-edge in the channel 12. Edge plates 13 arranged parallel to the back plate 11 also cooperate to define a portion of the channel 12 as do a pair of spaced plates 15. The space between the back plate 11 and edge plates 13 is substantially equivalent to the thickness of the coins 1–3 and the space between the spaced plates 15 is substantially equivalent to the diameter of the coins 1–3. The ends of the spaced plates 15 terminate lower than the ends of the edge plates 13 and an elongated slender hole 14 is formed between the edge plates 13.

The back plate 11 extends past the edge plates 13 as shown in the drawings.

The back plate 11, edge plates 13 and spaced plates 15 define the channel 12 to pass coins 1–3 upwardly through the channel from an inlet end of the channel (not shown) to an outlet end. A hopper assembly (not shown) feeds coins into the chute inlet end and they are advanced through the channel 12 for dispensing thereof.

Figure 2:
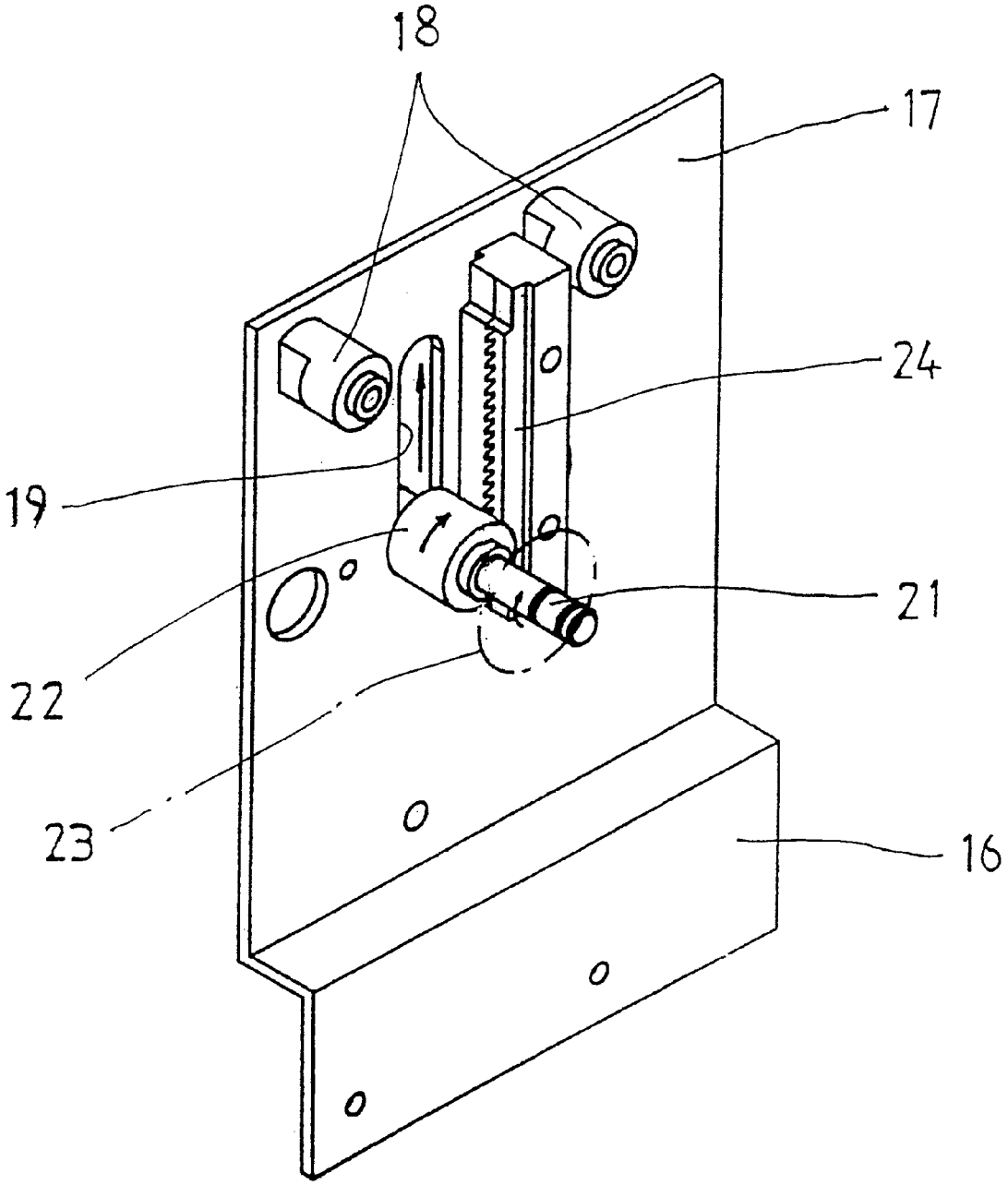
FIG. 2 is a perspective view showing portions of the interior of the device of FIG. 1.

With reference to FIG. 2, installation plate 17 is provided having a bent, lower portion 16. The installation plate 17 is secured to the back of the upper part of the back plate 11 through a pair of collars 18 and at the lower portion 16.

Centrally located at the upper portion of the back plate 11 is an oval hole 20 and similarly an oval hole 19 is provided on the installation plate 17. The longitudinal axes of the oval holes 19,20 are substantially aligned with the longitudinal axis of the channel 12 for the coins 1–3. That is, transverse lines through the holes 19,20 would intersect lines which link the axis of the coins 1–3 as aligned in the channel 12.

A shaft 21 extends through the holes 19,20 and is slidably moveable upwardly and downwardly in the holes 19–20 as shown in the drawings. Approximately at the center of the shaft is a larger diameter gear 22. A portion of the shaft 21 projects through the back plate 11 to mount a larger diameter roller 23. A one-way clutch is installed within the roller 23 so that it may freely rotate on the shaft in one direction and is driven by the shaft 21 when it rotates in another direction.

With reference to FIG. 2, there is a toothed rack 24 secured to the installation plate 17 to mesh with the gear 22.

Figure 3:
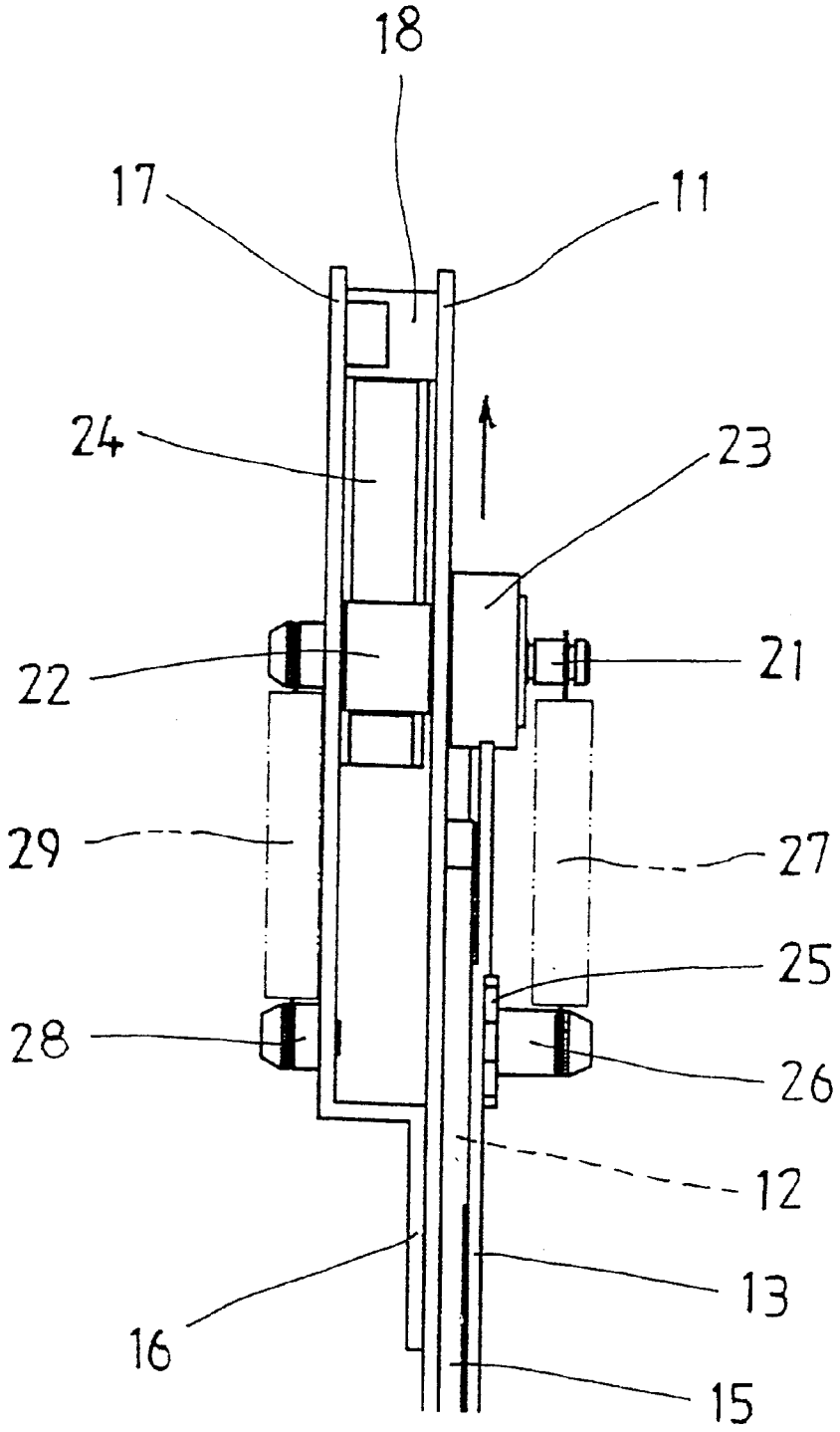
FIG. 3 is a left side view of the device of FIG. 1.

With reference to FIGS. 1 and 3, a horizontal plate 25 is secured over the upper portion of the edge plates 13 and proximate the center of the horizontal plate 25 is a stud 26.

To bias the shaft 21, a coil spring 27 is disposed between the stud 26 and the shaft 21 as best shown in FIG. 3. Also shown in FIG. 3 is a stud 28 centrally disposed at the lower part of the outside of the installation plate 17. A coil spring 29 extends between the shaft 21 and the stud 28. The springs 27,29 impose a bias on the shaft 21 in the direction toward the studs 26,28.

Figure 4:
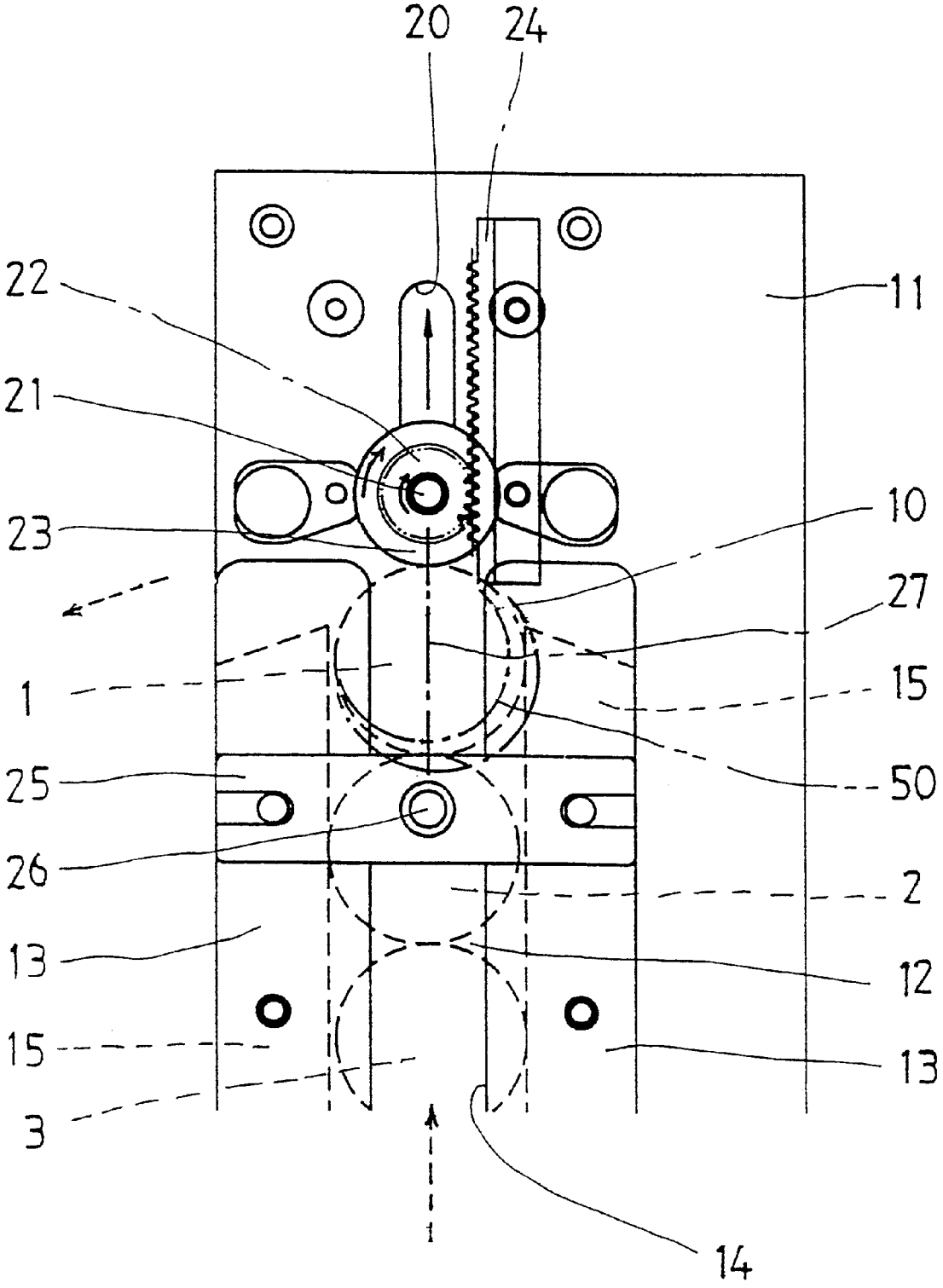
FIG. 4 is a front view of the device of FIG. 1.
Figure 5:
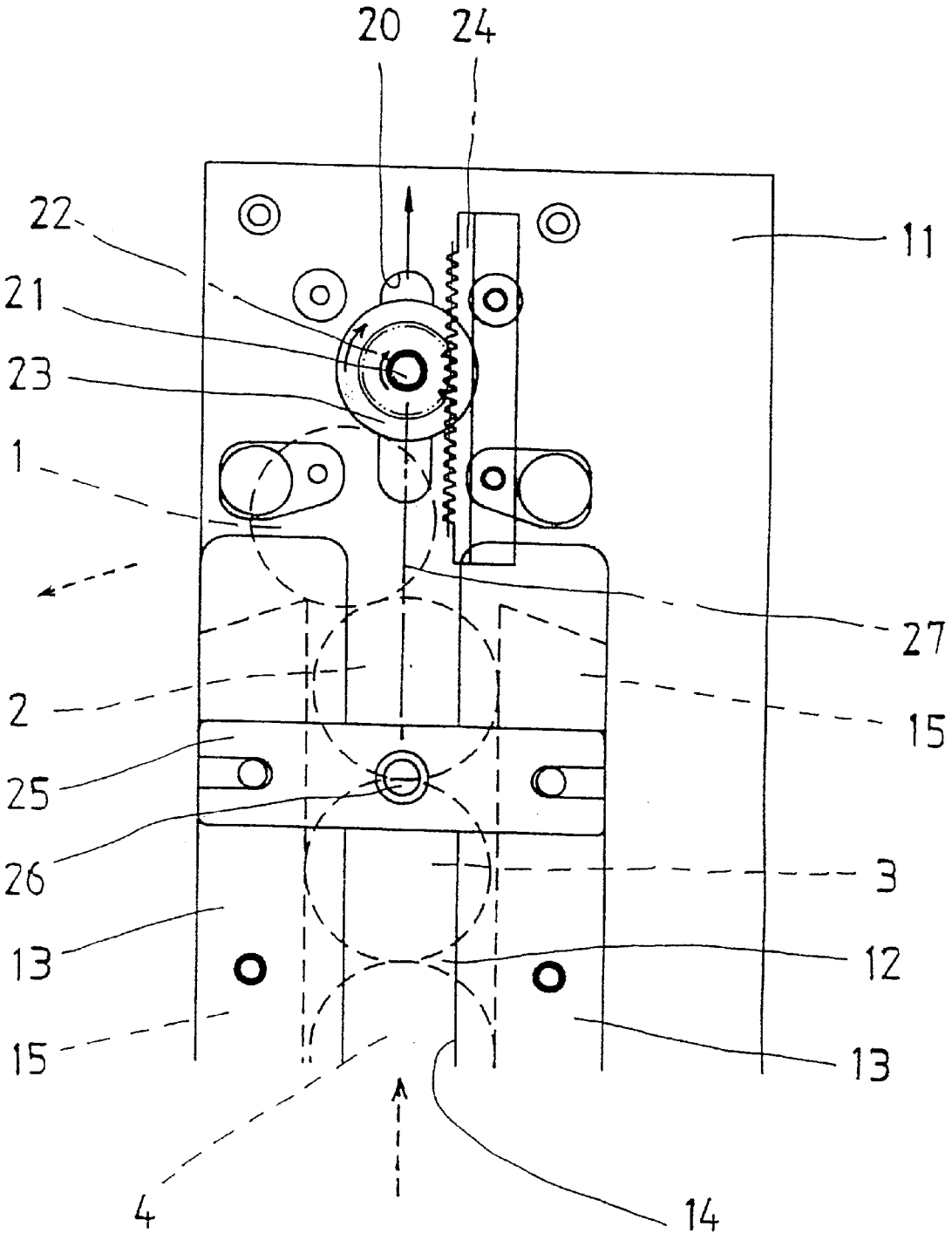
FIG. 5 is a front view of the device of FIG. 1 illustrating the ejection of a disk body.
Figure 6:
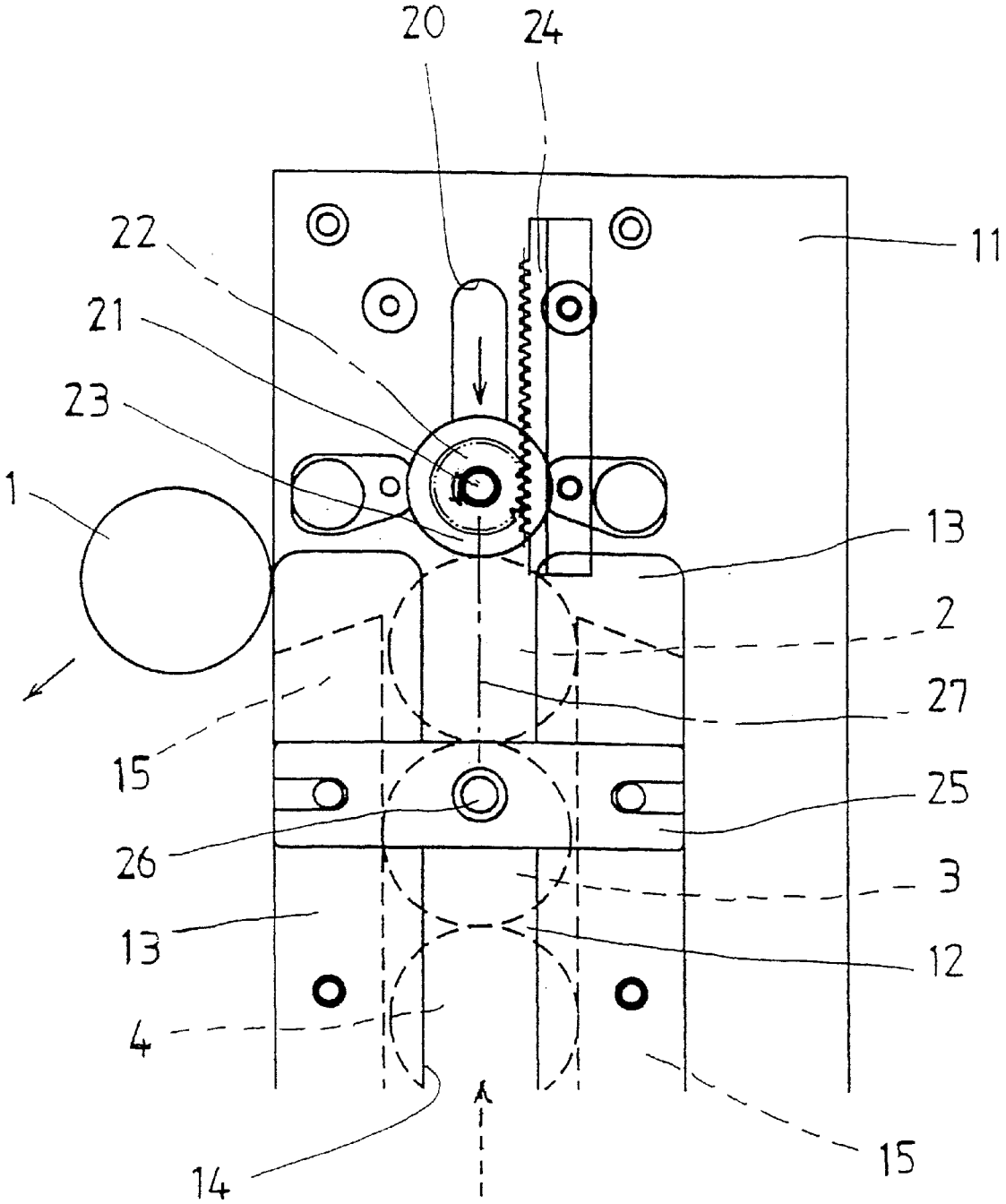
FIG. 6 is another view similar to that of FIG. 1 showing the ejection of disk body.

With reference to FIG. 4, the coins 1–3, etc. are pushed into the inlet end of channel 12 by dispensing equipment (not shown) which may be of the type known in the art for dispensing coins from hoppers. As the coins 1–3 are advanced through the channel 12 the upper most coin 1 engages the roller 23. As the coins are advanced, the coin 1 is pushed up against the roller which moves the shaft 21 through the holes 19,20 upwardly in the drawings against the bias of the springs 27,29. As the shaft 21 is urged upwardly, the gear 22 meshes with the rack 24 to rotate the roller 23 in a clockwise direction shown in FIG. 4 to urge the coin 1 as it emerges from the channel 12 leftwardly. When the coin 1 is forcibly sent to the left by the roller 23 and is ejected from the channel 12, the bias of the springs 27, 29 return the shaft downwardly in the drawings to position the roller 23 for engagement of the next coin 2. Even if the descending roller 23 engages the next advancing coin 2, the one-way clutch disposed between the roller 23 and shaft 21 prevents the rack 24 engagement with the gear 22 from rotating the roller 23 in an opposite (counter clockwise) direction. Accordingly the roller 23, by virtue of the one-way clutch, is permitted to only be driven by the rack 24 and gear 22 in a clockwise direction as shown in FIG. 4. In this way, coins 1–3 will only be dispensed to the left in FIG. 4.

As can be appreciated, the dispensing of coins 1–3 is smoothly done.

Figure 7:
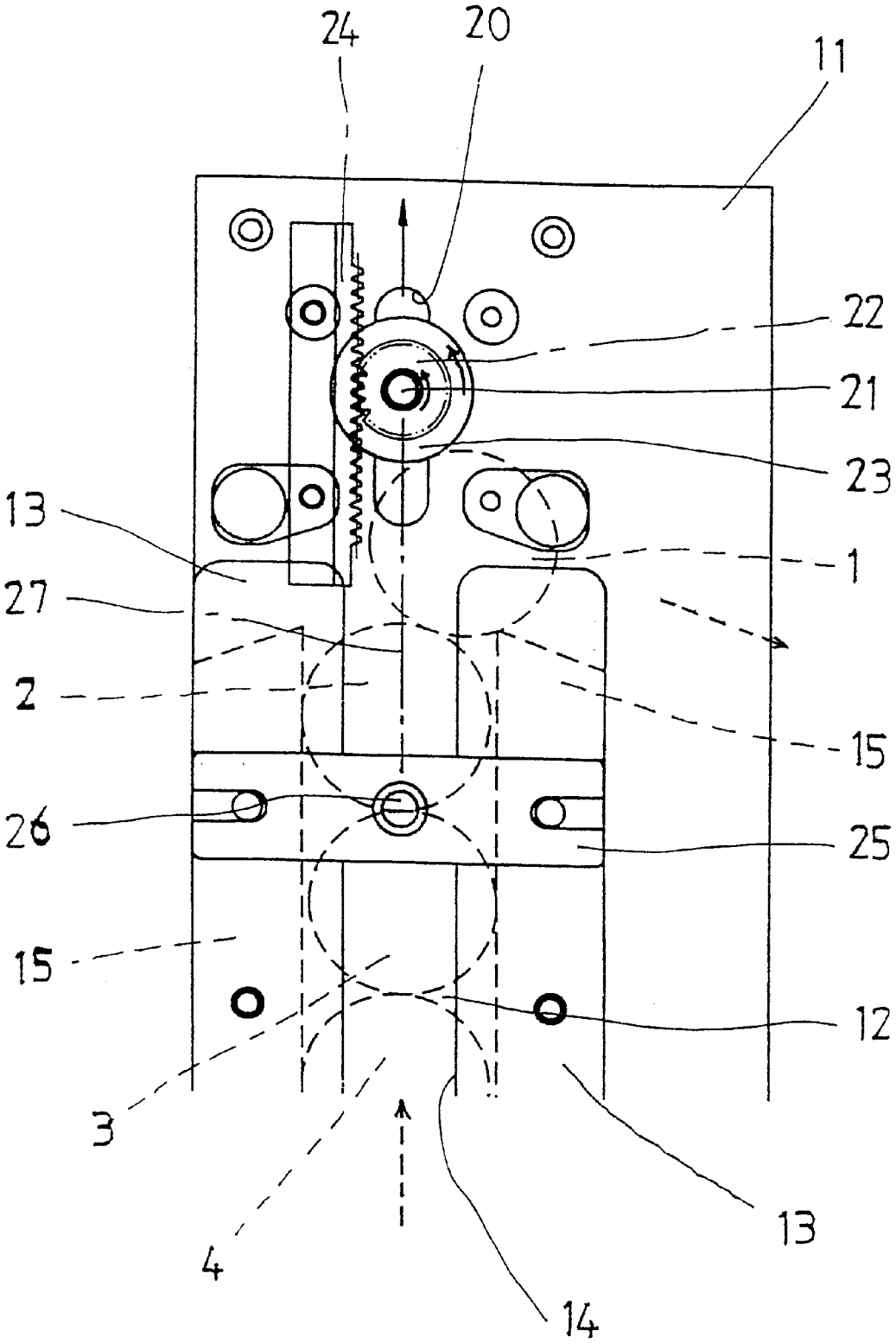
FIG. 7 is a view of another embodiment of the present invention similar to that of FIG. 1 showing ejection of the disk body to the other side of the channel.

With reference to FIG. 7, an embodiment is shown where the coins 1–3, etc. are sent to the right side of the drawing. According to this embodiment, the rack 24 is disposed at the left side of the hole 19,20 and the roller 23 with its one-way clutch is mounted reversely. That is to say, the roller is driven by the rack 24 as the shaft 21 moves upwardly in the holes 19,20 in a counterclockwise direction and is freely rotatable in a clockwise direction. As a result, the coins 1–3 of FIG. 7 are dispensed and ejected to the right in FIG. 7.

According to the embodiments of the present invention, the size of the circular plate bodies or coins 1–3 can be changed without changing the position of the roller 23 and shaft 21. It has been found that the roller 23 and shaft 21 arrangement of the present invention can be used with different diameter coins such as 100 Yen, 50 Yen and 10 Yen coins without changing the position of the roller 23. Accordingly, the ejecting apparatus embodied by the roller 23, shaft 21 and rack 24 need not be changed even though the size of the coins to be dispensed are changed.

While we have shown and described certain embodiments of the present invention, it is to be understood that it is subject to many modifications without departing from the spirit and scope of the claims.

I claim:

1. A device for dispensing circular plate bodies comprising:

a channel to guide said bodies fed into the channel at an inlet end in an edge-to-edge arrangement advancing to be ejected from an outlet end;

a roller displaceably disposed at the outlet end of the channel to engage the advancing body at the outlet end;

means for biasing the roller to contact the body during advancement and ejection and to return to engage the next body to be ejected; and means for rotating said roller in a first direction as it is displaced in response to advancement of the body to urge the body to one side from the channel for ejection thereof, said rotating means including a gear coupled to the roller for rotation therewith and a fixed rack adapted to mesh with the gear, said gear in response to movement of the roller adapted to rotate the roller in a clockwise and counter-clockwise direction.

2. The device of claim 1 further including means for preventing the roller from rotating and in one of said directions.

3. The device of claim 2 wherein the preventing means is a one-way clutch adapted to translate the rack and gear into rotation of the roller only when the roller is displaced in a first direction.

4. A device for for dispensing circular plate bodies comprising:

a channel to guide said bodies fed into the channel at an inlet end and advancing in an edge-to-edge arrangement to an outlet end;

a shaft at the outlet end of the channel mounting a roller adapted to engage bodies as the emerge from the outlet end;

means for mounting the shaft for displacement in response to the engagement of the roller with bodies advancing from the channel outlet end;

a gear mounted to the shaft;

a rack engaged with said gear and adapted to rotate the shaft clockwise and counterclockwise in response to displacement of the shaft;

a one-way clutch disposed between said shaft said roller to prevent rotation of the roller in one of said clockwise or counterclockwise directions and to drive rotation of the roller in the other of said directions to urge the body advancing from the channel to one side from the channel outlet end; and means for biasing the shaft to maintain contact between the roller and the emerging body during ejection and to return to engage the next body emerging from the channel second end.

5. The device of claim 4 wherein the biasing means is a spring.

6. An apparatus of ejecting circular plate bodies comprising:

a channel for arranging the circular plate bodies in an edge-to-edge arrangement, said channel having an inlet at a first end to admit the bodies into the channel and an outlet at a second end for the bodies to exit the channel, said channel having a longitudinal axis;

a moveable shaft mounting a roller at a position to contact the edge of a body emerging from the second end to eject it from the outlet;

means for biasing the shaft to maintain contact between the roller and body, said shaft disposed at and moveable along said channel axis against the bias as the body emerges from the second end;

a gear coupled to the shaft;

a one-way clutch coupling the roller to the shaft for rotation of the roller in a direction to eject the body from the outlet; and a rack meshing with the gear to rotate the shaft and roller in response to movement of the shaft against said bias.

* * * * *